United States Patent [19]

McGroarty

[11] Patent Number: 4,837,085

[45] Date of Patent: Jun. 6, 1989

[54] JOINT LEAK STOP MEMBRANE

[76] Inventor: Bryan M. McGroarty, 10233 Chicago Cir., Bloomington, Minn. 55420

[21] Appl. No.: 132,964

[22] Filed: Dec. 15, 1987

[51] Int. Cl.[4] ..... B32B 13/12

[52] U.S. Cl. ..... 421/451; 428/148; 428/149; 428/150; 428/331; 428/337; 428/913; 52/169.14; 52/309.11; 52/309.13; 52/309.14

[58] Field of Search ..... 428/148, 149, 150, 331, 428/337, 451, 913; 52/169.14, 309.11, 309.13, 309.14

[56] References Cited

U.S. PATENT DOCUMENTS 4,558,875 12/1985 Yamaji et al. ..... 52/169.14

4,581,864 4/1986 Shuckhman et al. ..... 52/309.14

4,693,923 9/1987 McGroarty ..... 428/248

*Primary Examiner*—Thurman K. Page

*Assistant Examiner*—P. J. Ryan

*Attorney, Agent, or Firm*—Kinney & Lange

[57] ABSTRACT

A waterproofing strip used to seal interfacing surfaces of building components has a single layer of a non-degradable, water impermeable polymeric membrane that has layers of particles of non-hydrated sodium montmorillonite (sodium bentonite) adhering to walls of the opposite surfaces thereof. The strip is placed between or across interfacing surfaces of two building components to prevent water migration.

9 Claims, 2 Drawing Sheets

JOINT LEAK STOP MEMBRANE

BACKGROUND OF THE INVENTION

1. Field of the Invention

The present invention relates to a waterproofing product comprising a sheet laminated with non-hydrated granular bentonite on both sides for stopping leaks in joints or interfaces of structures.

2. Description of the Prior Art

Reference is made to U.S. Pat. No. 4,693,923 showing a large waterproofing layer. The product of Patent '923 shows material on one side of the sheet only.

The prior art has various caulking materials and tape-type seals for waterproofing including products such as panels that use bentonite for waterproofing. Even though the desirable properties of bentonite for waterproofing have been known, the problems remain in obtaining a waterproofing seal for seams, particularly for poured concrete structures, that is easily used; that withstands weathering; that seals leaks well at joints and seams in both directions and will continue to provide waterproofing over the life of the structure.

SUMMARY OF THE INVENTION

The present invention relates to a waterproofing seal sheet and method of using the same wherein the sheet is made of an impervious flexible material or membrane (impervious to water), and has a layer of granular bentonite adhering to both opposite surfaces thereof. The bentonite particles are adhered to the sheet and built up to a suitable depth. The joint seal is generally narrow and long but can be made in sheets of substantial widths. The sheets can be rolled for transport.

The water impervious membrane with bentonite on both sides provides the waterproofing properties on both sides of the sheet so a source of water or leaks on either side is stopped. With joints in concrete formed by interfacing surfaces between two components this is very important. The seal strip stops water from flowing longitudinally along the joints or interface surfaces.

Almost any flexible impermeable membrane constructed of polymers such as high density polyethylene and polypropylene can be used for the membrane in the present device. Further, chlorinated polyethylene, polyvinylchloride, neoprene and butyl sheets among others can also be used by adding the layers of bentonite onto opposite sides of the sheet sealing strip.

The seal strip with bentonite adhered can be layed against the edge of previously poured concrete and the new pour added. Using nailing or adhesives, the sealing strip remains in place and prevents migration of water from either side of the joint or interface. If a tough polymer is used, such as high density polyethylene, a product that is not susceptible to damage is achieved.

The bentonite is self-sealing and swells to stop any migration immediately. Water migration along joints in structures has been a cause of great unsatisfaction of users of buildings, and has been the cause of innumerable lawsuits because of the difficulty involved in detection of the origin of the leak.

An apparatus for manufacturing waterproofing sheet composites having bentonite particles on at least one side is disclosed in U.S. Pat. No. 4,693,923, which can be used for covering both sides. The layers of bentonite can be applied as a mixture of particles and adhesive and merely spread on the opposite sides of a sheet if desired.

Other techniques for making the strips can be used as well.

The finished composite sealing strip is then placed in rolls for storage and shipment to the job site, where it is cut into the proper lengths for installation.

DESCRIPTION OF THE PREFERRED EMBODIMENTS

Figure 1:
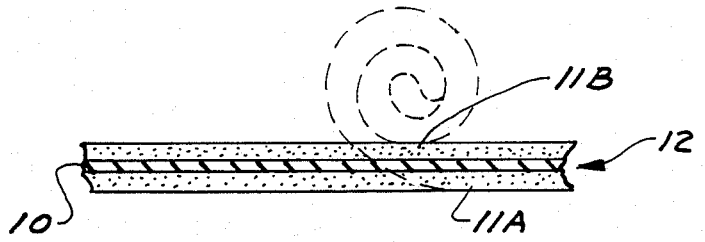
FIG. 1 is a side view of a composite waterproofing sealing strip made according to the present invention.

FIG. 1 illustrates a finished composite waterproofing sealing strip 12, made according to the present invention and comprises, preferably a membrane 10 of material that is impervious to water, such as high density polyethylene PVC, neoprene or the like, and an adhered waterproofing layer of bentonite (sodium montmorillonite) on each side thereof indicated at 11A and 11B.

It is to be understood that the layers 11A and 11B are meant to indicate a finished thickness of bentonite made up of individual bentonite particles (with interspersed adhesive) applied to a desired thickness on each side of sheet 10 and made into a sandwich type composite waterproofing sheet 10.

Figure 2:
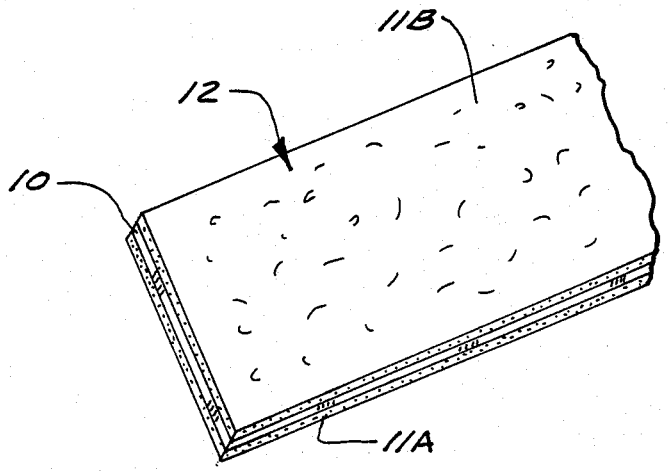
FIG. 2 is a fragmentary perspective view of a composite waterproofing sealing strip made according to the present invention.

The layers of particles 11A and 11B extend the length and width of the sealing strip 12. In FIG. 2, a perspective view of a typical sealing strip is shown. The manufactured widths usually run from about one inch to eight inches and length typically is 25 feet or more.

Thus the composite structure comprises a flexible water impervious membrane in sheet form having layers of particles for waterproofing, preferrably bentonite particles, on the opposite surfaces at a desired depth.

Adhesives that provide proper holding action are important. Various adhesives will work with bentonite, however it must be remembered that bentonite is highly reactive with many monovalant, divalant and trivalant compounds. Such reaction products should be avoided in making the composite waterproofing sheets so that the bentonite particles do not lose their desirable property of swelling when contacted by water. The choice of adhesive is carefully made for the composite waterproofing sheet 10. The adhesive has to have the ability to adhere the bentonite particles to a polyethylene or other water impervious membrane, and minimize the degradation of the waterproofing capabilities of the bentonite. Adhesive materials are available as emulsions with water, solutes, concentrates, hot melts and often in homo or copolymer status. Almost any adhesive originating from a solvent, emulsion with water, or hot melt may be used, and the choice is determined by the ability to wet, its stickiness, the polar activity, reactiveness and the final adhesion performance. The choice is influenced by price, toxicity, availability, and environmental considerations as well. The addition of wetting agents, emulsifiers, dispersants and preservatives used in emulsions (latexes) can cause deterioration of the bentonite's ability to waterproof or reseal, so use of these products may be minimized.

Adhesion to high density polyethylene has been difficult, and a common procedure to enhance adhesion is to chemically disturb the surface of the polyethylene or polymer membrane just prior to the application of the adhesive, for example by treating it with ozone. This brings in time limitations which means that the membrane has to be coated quite quickly because the molecules that are affected by the treatment migrate back to their original smooth alignment relatively fast.

The total thickness of the layers of bentonite particles is built up to in the range of $\frac{1}{8}$ inch to $\frac{1}{4}$ inch thick on each side of the sheet 10, and thus a method of continuously achieving a permanent adhesion to the polyethylene membrane is desired. The bentonite particles can be mixed with adhesive and applied as a paste if desired, or sprayed onto the membrane sheet 10 as a mixture. The surface of the polyethylene preferrably is roughened. Roughening can be done by stretching the polyethylene to microscopically "craze" the surface of the polyethylene. The amount and the direction of the tension applied to the membrane is determined by the thickness of the membrane. Generally, tensioning the membrane to about 30 lbs per square inch is acceptable for thicknesses of 20 to 40 mils. The membrane used herein is most preferably in the range of 20 to 40 mils, but the functional range is 15 to 100 mils in thickness. Tensioning can be done by passing the polyethylene membrane over rollers which apply a stretch between pinch drive rollers.

The adhesive used must wet the polyethylene surface for good adhesion, and low surface tension solvent systems provide a suitable vehicle to carry the adhesive.

Aliphatics, aldehydes, ketones, carbon/halide and ring compounds all have utilization. Common carriers/-solvents include toluene, lower molecular weight alcohols, methylketone, and water. For example, the following products may act as suitable adhesives.

Asphalts (with or without fillers and elastomers)
Butylenes
Butyl Rubber
Acrylics
Propenes
Styrene/butadiene
Nitriles
Vinyls
Water Soluble:
  Cellulosics
  Saccharides
  Gums
  Proteins.

In general, the adhesive solids should be present in concentrations from about 5 to 100% by weight, and are mixed with bentonite in ratios of between 3 and 50% by weight of the adhesive relative to the particles (bentonite).

In a continuous process for applying the bentonite, the method of tensioning or stretching the polyethylene membrane (or other membrane) can be used applying known principles. Additionally, treated polyethylene can be obtained that has the ozone treatment previously mentioned.

Figure 3:
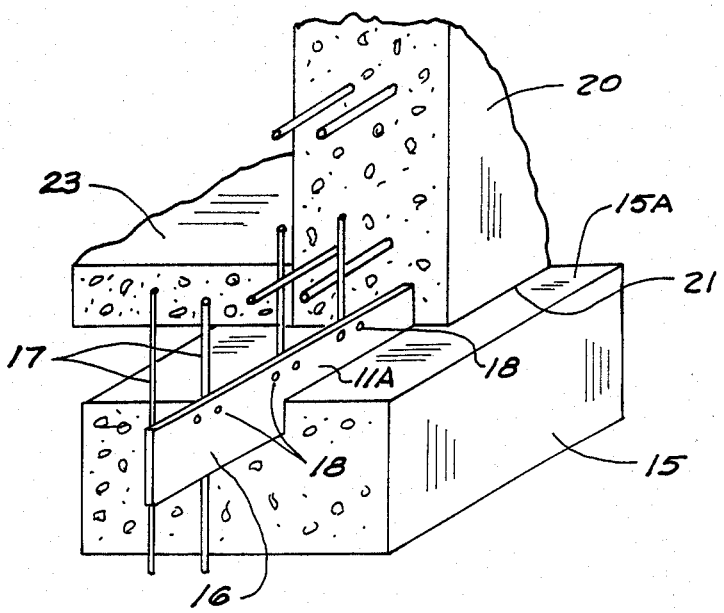
FIG. 3 is a perspective view of a poured footing with a sealing strip in a typical position.

After the bentonite and adhesive material has been applied to both sides of the sealing strip membrane, as will be explained by way of a typical example, the strips are packaged into rolls as shown in dotted lines in FIG. 1 for shipment to a job site. Typical uses are for preventing leaks or liquid migration in cold joints of concrete. In FIG. 3, a concrete footing 15 for a building is shown and before pouring, a triple composite sealing strip 16 made as described in connection with FIGS. 1 and 2 is supported on reinforcing steel bars 17 with wire ties 18, so that the strip partially is in the concrete footing 15 and partially protrudes above the footing when the footing is poured. In other words, the upper portion of the sealing strip 16 protrudes above an upper surface 15A of the footing. The strip 16 can extend for the full length of the footing, and two strip segments can be overlapped if the footing is more than 25 feet long or is longer than the strip in the roll. The sealing strip 16 is placed on the wet side of the steel 17, that is, it is placed on the side from which water is expected to come.

The concrete usually is permitted to set, and the upper half of the sealing strip 16 will remain protruding out of the upper surface 15A of the footing 15.

The wall 20 is then poured in a normal manner and the upper half of sealing strip 16 is embedded uprightly in the wall.

The triple composite strip 16 has its first surface 11A facing the water. Any tendency of water to migrate or flow at the joint line shown at 21 between the base of the wall 20 and the upper surface 15A of the footing will result in the bentonite layer 11A operating to swell and prevent water from passing through this interface surface.

Since the strip 16 is a triple composite, if there should be water coming from the opposite side, the layer 11B would be effective to prevent migration of water or stop leaks along the interface shown at line 21.

Figure 4:
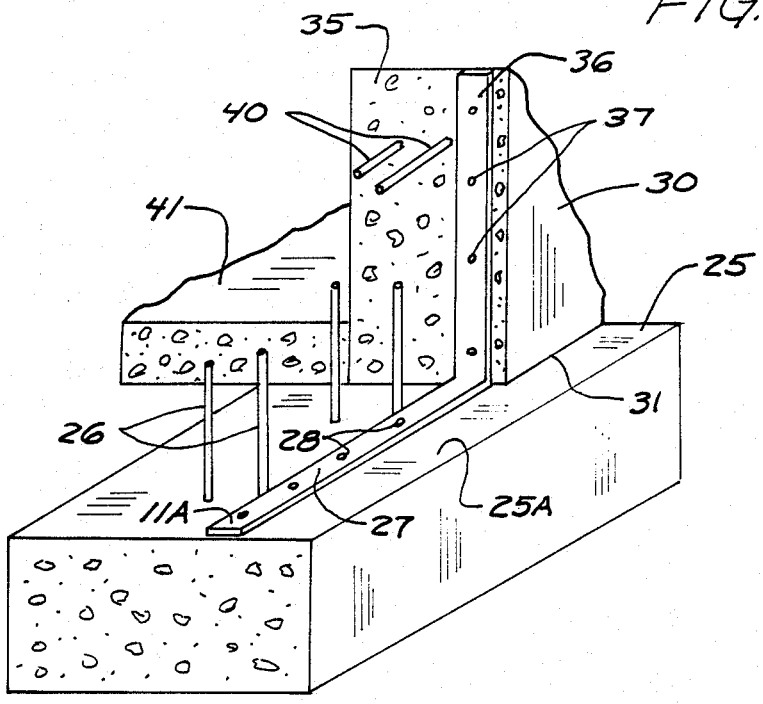
FIG. 4 is a perspective view a typical poured concrete wall on a footing showing the composite sealing strip made according to the present invention in place in a horizontal installation.

In FIG. 4, application of the sealing strips in a horizontal position is shown. This will prevent water migration along the interface between a wall and a footing. In FIG. 4, a footing 25 has been poured, and it has reinforcing steel 26 therein. The upper surface 25A of the footing 25 is finished off, and a sealing strip 27 made according to the present invention, which is a triple composite sealing strip, is fastened so its plane is horizontal, as shown, with suitable nails or other fasteners 28. The layers 11A and 11B, are then horizontal, and the layer 11B engages the surface 25A, while the layer 11A as shown is upwardly facing. In this instance, when a wall 30 is poured over the surface 25A, the layer 11A will form an innerface along the joint surfaces that are represented along the line 31, between the surface 25A and the bottom surface of the wall 30. Any migration of water will be stopped because of the swelling properties of the bentonite layers 11A and 11B, one of which is in contact with the surface 25A and one of which is in contact with the bottom surface of the wall 30.

Additionally, if there is a cold joint surface, such as that shown at 35 on wall 30, a suitable sealing strip 36 made according to the present invention can be laid in position, and fastened with suitable nails or other fasteners 37 on the vertical cold joint surface. The triple composite strip, including the two layers of bentonite 11A and 11B has the layer 11B on the surface 35 and the layer 11A exposed for contacting the additional wall section that will be poured.

When the vertical joint is formed, it can be seen that with the strip 36 on the wet side (the side that is normally toward the water source) of the reinforcing steel 40 in the wall, water migration along the innerfacing surface 35 and the surface of the additional wall section formed at this joint will be stopped to prevent water migration or leaks inwardly.

The sealing strips also can be used between the upper surface of the footings such as that at 25A and 15A, and the lower surface of a poured slab floor which is indicated at 23 in FIG. 3, and 41 in FIG. 4. Such a sealing strip would be laid horizontally under the floor slab like the strip 27 along the surface 25.

Figure 5:
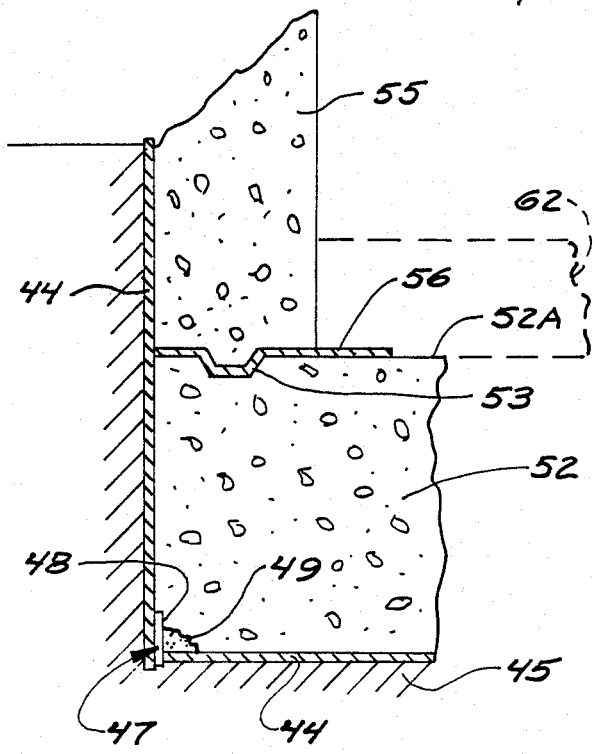
FIG. 5 is a vertical cross sectional view of a slab and wall junction showing use of the sealing strips.

Thus there is no water migration through the sealed joints. Additionally, as illustrated in FIG. 5, where a slab is being poured onto a suitable filling and a vertical wall is also poured, utilizing the waterproofing sheets shown in U.S. Pat. No. 4,693,923 along with the sealing strips, a complete waterproofing arrangement can be made. The triple composite sealing strip of the present invention can be laid to prevent water migration longitudinally along the wall and to seal junction of the waterproofing sheets.

As shown, sealing sheets 44 as disclosed in U.S. Pat. No. 4,693,923 can be provided along the vertical walls and over the ballast or filling against which the concrete mat is poured. The ballast indicated at 45 can be any type of ballast.

At the corner between the horizontal and vertical waterproofing sheets indicated generally at 47 a sealing strip 48 made according to the present invention, which is a triple composite sealing strip can be placed at the junction. A filling of loose particles of bentonite shown at 49 can be added, to insure that there will be an adequate seal when the concrete mat 52 is poured. The concrete mat 52 has am upper surface 52A, and a key joint 53 is provided where a wall 54 will be poured. A sealing strip indicated generally at 56 made according to the present invention is laid so that its longitudinal length is perpendicular to the surface of the wall 55, and extends outwardly across the key joint. Then when the wall 55 is poured in place, there will be a narrow sealing strip at the location of the strip 56. This strip 56 can then be placed along the longitudinal length of the wall at regular intervals, for example 15 feet on center, to prevent water from migrating along the key joint from a water source to other locations where the leak might appear. This isolates leaks, and insures that a water tight arrangement is provided (see the reduced scale view of FIG. 6).

By using the triple sealing strips at all joints or in corners between the large sealing sheets 44, and the concrete slab or mat 52, as well as spaced along the longitudinal length and extending at right angles to the plane of the wall, water leaks can be isolated and prevented from migration.

Additionally, the sealing strips can be used for horizontal installations with waterproofing membranes on roofs, by providing the sealing strips made according to the present invention on top of the slabs that are used for roofs. The strips can be placed underneath a regular waterproofing sheet, as well as on surfaces where there are interfaces with other structural components.

The sealing strips, as stated, can have a width in the range of one to eight inches, with two to three inches being the most common with the triple composite, having bentonite-adhesive layers on opposite sides of a high density polyethylene layer, sealing can be made in cold joints and concrete as illustrated, as well as joints between metal components, wood components or the like to create water dams between horizontal surfaces of a substrate and a deck covering, as well as along vertical joints, which may be subject to water migration, particularly if they are below ground. The triple composite strips as shown will prevent movement of water around the sealing strips at water heads in excess of 50 feet.

The sealing strips have the beneficial properties of elongation and ability to bend, due to the characteristics of the high density polyethylene, and can be installed in temperatures as low as minus 30° F. up to 140° F., and can operate in temperatures from minus 45° F. to 270° F. Of course, the operating temperature range is such that the sealing properties will not be destroyed at those low temperatures, and will be operable when the temperature again reaches a level where water will be liquid.

There is no toxicity or staining with the strips, and freeze-thaw, and wet-dry cycles do not adversely affect the properties of the bentonite and adhesive layers on the triple composite sealing strip.

Figure 6:
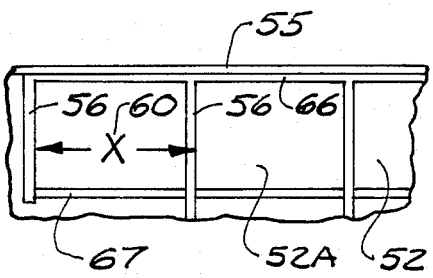
FIG. 6 is a substantially reduced scale schematic representation of a wall and horizontal surface layout showing the sealing strips forming a grid for isolating leaking areas.

In FIG. 6, a representation of use of the sealing strips 56 to provide for spacings along the longitudinal length of a wall 55 is illustrated schematically. The sealing strips 56 can be extended even across the joint as shown, and out over a surface 52A of the mat 52, with a spacing indicated by the dimension X at 60. The spacing as stated can be about 15 feet on center, and will stop water migration along the joint between the wall 55 and the mat 52, and also if an overlying layer of additional material is added, which is indicated in dotted lines at 62 in FIG. 5, is placed over the strips, the areas can be isolated by the sealing strips 56 forming a grid. The layer 62 could be a layer of roofing materials for example. Additionally, a sealingstrip 66 can be provided parallel to the wall 55, right at the junction of the wall 55 and the mat 52, and a second strip 67 parallel to strip 66 can be spaced outwardly from wall 55 at a desired spacing again, for example 10 or 15 feet out to insure that water tending to migrate along the surface 52A will be stopped at desired locations.

The sealing strip of the present invention obviates the need for heavy caulking, or layers or material placed along corner joints.

The second pour of concrete will merely close or mold around the exposed portion or surface of the sealing strip 16 without damage to the strip. An adequate water seal will be provided all along the strip where the strip passes along a joint wall.

The horizontal sealing strips can be applied wherever desired for maintaining the waterproofing integrity along joints. The sealing strips can be used between any types of material, including sealing along interfaces or junction edges of layers of wood or metal framing materials, as well as concrete and other poured building materials.

The particle size of bentonite used can be between 5 and 150 mesh using standard U.S. standard mesh sizes. If desired, air entraining of particles (fluidizing) can be used for feeding the particles.

The coating or composite layer of bentonite is built up to a total weight of about one pound per square foot for adequate waterproofing characteristics for the composite sealing strip 12.

The sealing strip protects against water migration and leaks in joints at junctions or interfaces of building components easily and quickly.

Although the present invention has been described with reference to preferred embodiments, workers skilled in the art will recognize that changes may be made in form and detail without departing from the spirit and scope of the invention.

What is claimed is:

1. A sealing strip comprising:

a membrane of water impermeable material; and a continuous layer of particles capable of swelling when in contact with a liquid adhered to both major surfaces of the membrane, the layers having a thickness on both major surfaces thereof sufficient to stop liquid migration between interfacing surfaces engaging the sealing strip.

2. The sealing strip of claim 1 wherein said particles comprise sodium montmorillonite of a classified mesh size in the range of 5 to 150 U.S. standard mesh size.

3. The sealing strip of claim 2 wherein each layer, on opposite sides of the membrane, comprise a plurality of individual layers of particles held in place with an adhesive selected from a group consisting of aliphatus, ketones, carbon/halide and ring compounds to hold the particles together and adhering to the membrane.

4. The sealing strip of claim 2 wherein said membrane comprises a high density polyethylene, the sealing strip having sufficient resistance to loss of particles so as to be capable of being rolled into a roll after the layers of particles have been applied on opposite sides of the membrane.

5. A method of sealing joints between first and second building components each having interfacing surfaces comprising the steps of:

providing a sealing strip of material having a central sheet, and a separate layer of a swelling clay such as bentonite particles on each side thereof;

forming the first building component so that a portion of the first surface thereof is exposed;

placing the provided strip so that it traverses the first surface; and placing the second building component with a second surface thereof oriented to the first building component surface so that the separate swellable layers form leakage barriers at the interfacing surfaces of the building traversed by the sealing strip to prevent movement of water in selected locations.

6. The method of claim 5 wherein the interfacing surfaces are generally planar surfaces having a longitudinal length, and the provided strip has a plane that extends substantially perpendicular to the longitudinal length of the planar surfaces and traverses both the first and second planar surfaces.

7. The method of claim 5, wherein the interfacing surfaces are generally complementary in shape and face each other, and the provided sealing strip traverses the surfaces by interfacing between the facing surfaces and engaging both of the surfaces while extending complementary in shape to both such surfaces.

8. The method of claim 5 wherein the building components comprise poured concrete, the step of providing a sealing strip of material comprises inserting the sealing strip into the first building component before the building component and cures, leaving a portion of the sealing strip extending generally outwardly from the first surface of the first building component, and forming the second building component to surround the sealing strip at the location where it extends outwardly from the first surface so that the second surface of the second building component mates with the first surface of the first building component and the sealing strip extends across both surfaces.

9. The method of claim 5 including the step of placing the sealing strips having a narrow width at spaced locations along the same surface to form barriers at substantially parallel spaced lines along the surface.

* * * * *